United States Patent [19]

Gange

[11] 4,167,690

[45] Sep. 11, 1979

[54] CATHODE AND METHOD OF OPERATING THE SAME

[75] Inventor: Robert A. Gange, Belle Mead, N.J.

[73] Assignee: RCA Corporation, New York, N.Y.

[21] Appl. No.: 792,569

[22] Filed: May 2, 1977

[51] Int. Cl.[2] ..... H01J 29/70; H01J 29/72

[52] U.S. Cl. ..... 315/366; 315/105; 313/422

[58] Field of Search ..... 315/366, 102, 13 R, 315/105; 313/422; 328/270

[56] References Cited

U.S. PATENT DOCUMENTS

| | | | |
|---|---|---|---|
| 2,916,668 | 12/1959 | Dyke et al. | 315/105 |
| 2,965,801 | 12/1960 | Archer et al. | 315/366 |
| 3,229,169 | 1/1966 | Deming | 328/270 |

*Primary Examiner*—Theodore M. Blum
*Attorney, Agent, or Firm*—Eugene M. Whitacre; Donald S. Cohen; Vincent J. Coughlin, Jr.

[57] ABSTRACT

A series of discrete heating current pulses are passed through a line cathode so as to cause the cathode to emit electrons therefrom. Between each consecutive pair of pulses is a cooling period during which no heating current flows through the cathode. Current is extracted from the cathode during this cooling period. In a preferred embodiment for an image display device, the heating pulse duration is about 10 μsec and the cooling period is about 50μsec. In this scheme, the heating period corresponds roughly to the horizontal retrace time between line times of 50μsec.

16 Claims, 14 Drawing Figures

(a)

(b)

CATHODE AND METHOD OF OPERATING THE SAME

BACKGROUND OF THE INVENTION

This invention relates to a cathode, and particularly to structures and methods of operating the same in which a directly heated line cathode is employed.

Conventional kinescope tubes are generally limited to sizes and shapes which preclude realization of a flat image display device. One approach to obtain such a display device has been to employ a substantially flat tube having therein a line cathode. In this structure, the line cathode is utilized in combination with means for guiding electron beams therefrom to selectively strike predetermined portions of a cathodoluminescent screen. For examples of such structures see: copending applications of Stanley, Ser. No. 607,492, filed Aug. 25, 1975, entitled "FLAT ELECTRON BEAM ADDRESSED DEVICE, now U.S. Pat. No. 4,031,427, issued June 21, 1977"; and of Anderson et al., Ser. No. 615,353, filed Sept. 22, 1975, entitled, "GUIDED BEAM FLAT DISPLAY DEVICE, now U.S. Pat. No. 4,028,582, issued June 7, 1977".

One problem with the previously mentioned flat display device is the use of an indirectly heated cathode. The indirectly heated cathode is undesirable as its structure is generally more complex than a directly heated cathode. However, the use of a directly heated cathode has heretofore been discouraged because of other problems; the voltage drop across the line cathode due to the heating current usually exceeds the value allowable for injection into a series of guides operated at common voltages, and the voltage drop across the line cathode during operation often degrades the uniformity obtainable in a display device employing the same.

Thus, it would be desirable to develop a method and structure which employs a directly heated line cathode for use in a flat image display device.

SUMMARY OF THE INVENTION

The invention includes an image display device of the type having: an evacuated envelope with a cathodeluminescent screen therein; a line source of electrons; and means for guiding electrons from the line source to the cathodoluminescent screen. The line source of electrons includes: a directly heated line cathode which emits electrons upon the passage of heating current therethrough; means for providing the cathode with a plurality of discrete heating current pulses with a predetermined time period separating consecutive ones of the discrete current pulses; and means for extracting current from the cathode with current being extracted during at least a portion of the predetermined time period.

A method of operating a line cathode includes providing the cathode with a plurality of discrete heating current pulses with a predetermined time period separating consecutive ones of the discrete heating pulses. Current is extracted from the cathode during at least a portion of the predetermined time period.

DETAILED DESCRIPTION OF THE INVENTION

Figure 1:
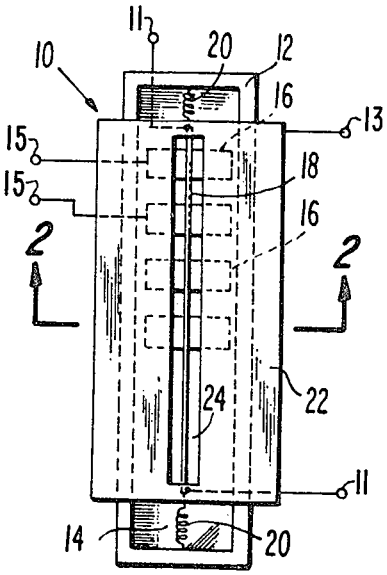
FIG. 1 is a plan view showing one form of a cathode structure of the present invention.
Figure 2:
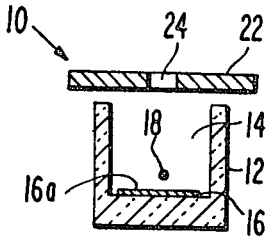
FIG. 2 is a sectional view taken along line 2—2 of FIG. 1.
Figure 3:
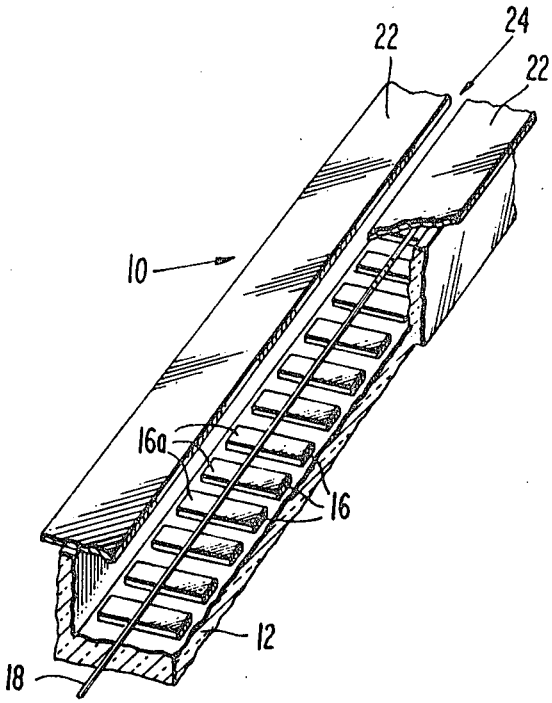
FIG. 3 is a partially broken away perspective view showing the cathode structure of FIGS. 1 and 2.

Referring initially to FIGS. 1–3, one form of a cathode structure of the present invention is generally designated as 10. The cathode structure 10 includes an electrically insulating substrate 12, such as quartz, which includes a cavity 14. On the surface at the bottom of the cavity 14 are a plurality of discrete electrode pads 16. A filament 18, also referred to as a cathode, is suspended in the cavity 14 and extends across the surfaces 16*a* of the pads 16 such that separate portions along the length of the filament 18 are associated with different ones of the electrode pads 16. The filament 18 is a directly heated filament, such as a tungsten body which has been cataphoretically coated with an emissive carbonate. A suitable emissive carbonate may comprise about 13% $CaCO_3$, 31% $SrCO_3$ and 56% $BaCO_3$. The diameter of the filament 18, including the emissive coating, is typically about 0.25 mm. The filament 18 is maintained in place in the cavity 14 by applying tension to both ends of the filament through springs 20. Further information on constructing the filament 18 can be found in copending application, Ser. No. 673,988 entitled, "Method and Apparatus for Cataphoretic Deposition," filed Apr. 15, 1976, now U.S. Pat. No. 4,026,780, issued May 31, 1977, which is hereby incorporated by reference.

An electrode 22, having an aperture 24 therein, is positioned in spaced relation to the cathode 18 with the cathode 18 being included between the electrode pads 16 and the apertured electrode 22. The aperture 24 may be in the form of a single slit.

Schematically shown in FIG. 1 are terminals for operating the cathode structure 10 in accordance with the method of the present invention. These terminals include cathode heating power input terminals 11 (one of which may be held at ground potential); a terminal 13 for applying an electrical potential to the apertured grid 22; and separate terminals 15 for applying electrical potentials to each of the electrode pads 16.

Generally, in the operation of the cathode structure of the present invention, heating current is passed through the cathode 18 so as to cause the cathode to reach an elevated temperature, 760° C., whereby electron emission occurs. However, contrary to conventional cathode operation, current is extracted from the cathode during a period in which no heating current passes therethrough, i.e., during a cooling period. The current is extracted through the application of appropriate voltages to the aperture 24 and electrode pads 16.

More specifically, in one embodiment, when electron transmission through the aperture 24 is desired ("on" condition), depending upon dimensions and desired current, the cathode 18 and electrode pads 16 are maintained at 0 volts while the apertured electrode 22 is maintained at values which range from about +10 volts dc to about +100 volts dc. Electron transmission through the apertured electrode 22 can be cut off ("off" condition) by changing the electrical potential at one or more of the electrode pads 16, i.e., by making the electrode pad(s) negative with respect to the cathode 18, thereby causing electrons emitted at the cathode 18 to be trapped there. This concept of extraction through electrode pad control is more fully discussed in copending patent application, Ser. No. 737,098, entitled "Cathode Structure and Method of Operating the Same," filed Oct. 29, 1976 and subsequently abandoned, but see continuation-in-part, Ser. No. 784,365, filed Apr. 4, 1977.

Figure 4:
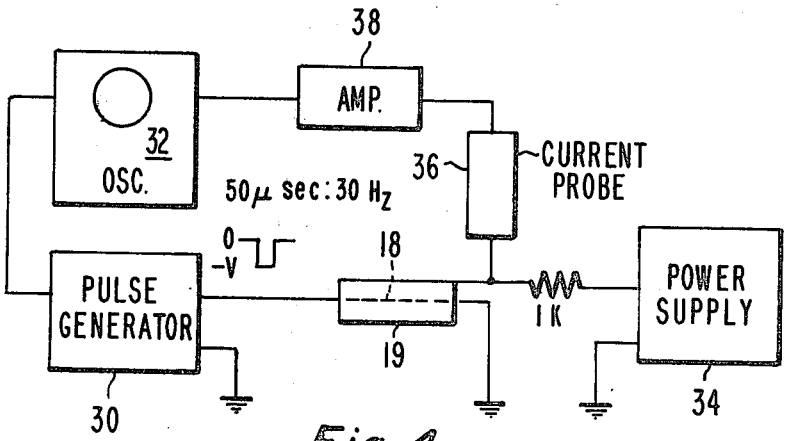
FIG. 4 is an exemplary circuit for operating a cathode structure in accordance with the method of the present invention.

An exemplary circuit for operating and monitoring a line cathode structure in accordance with the method of the present invention is shown in FIG. 4. For simplicity of description, the line cathode 18 is defined as a directly heated filament 18 (cathode) suspended in a conductive cylinder 19 (anode).

The circuit includes a pulse generator 30 for supplying a plurality of substantially constant discrete heating voltage pulses to the cathode 18. Each of the discrete heating voltage pulses causes a heating current pulse to pass through the cathode. The pulse generator 30 should be capable of an output of 1 Amp at 50 volts for a 25 micron diameter, 1 meter long cathode. One such pulse generator is commercially available from Hewlett Packard under the designation HP214A. For the purposes of this description, the output of the pulse generator 30 is also directed into an oscilloscope 32 for monitoring purposes. The oscilloscope 32 is preferably capable of displaying two signal wave forms simultaneously. A power supply 34, capable of an output of 400 volts, e.g., one commercially available from Kepco Co., Flushing, N.Y., under the designation HB8AM Kepco, is connected through a 1000 ohm resistor to the conductive cylinder 19. A current probe 36 is connected to the conductive cylinder 19 where it measures the current extracted from the filament. A suitable current probe is the one commercially available from Tektronix under the designation P6022. The output of the current probe 36 is directed into an amplifier 38, e.g., a #134 Tektronix amplifier, and the amplified output is directed into the oscilloscope 32. The oscilloscope 32 thus simultaneously displays, as a function of time, both the heating voltage pulse input to the cathode and the extracted current output.

EXAMPLE

The following discussion relates to a line cathode 5 cm in length and 20 μm in diameter which was operated through the method of the present invention. The cathode was evaluated in a sealed nickel conductive tube 19 having an outside diameter of about 0.3 cm and a length of about 3 cm. The cathode was operated and monitored through the use of the exemplary circuit shown in FIG. 4.

Figure 5:
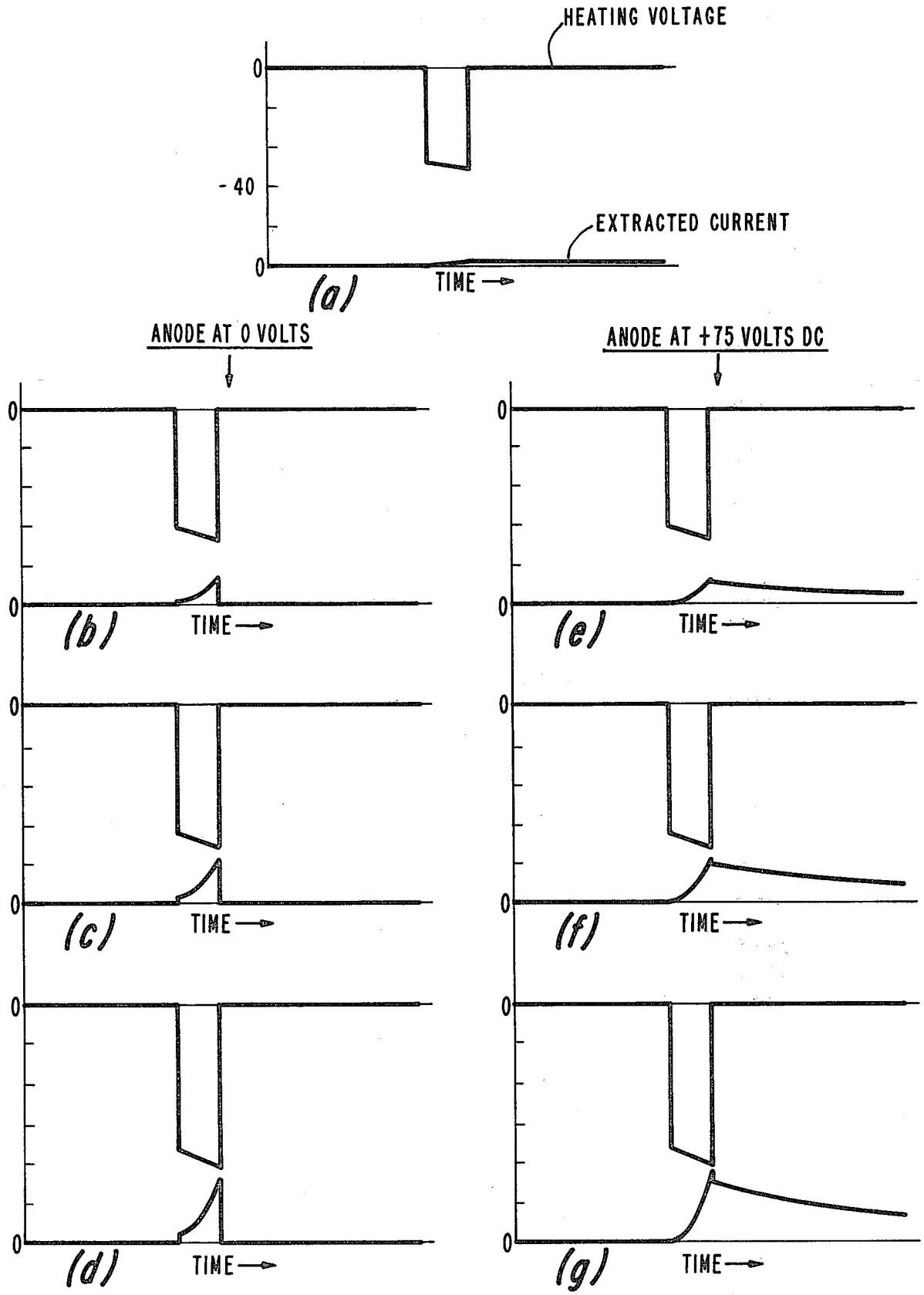
FIGS. 5*a* . . . *g* are a series of graphs showing the current extracted from a cathode as a function of time wherein the cathode is operated in accordance with the method of the present invention.

Referring now to the graphs of FIGS. 5*a* . . . *g*, it is to be understood that the upper trace represents the heating voltage pulse to the cathode while the lower trace represents the current extracted from the cathode. In this example, as in FIG. 4, the heating voltage pulses are negative polarity so as to produce a voltage gradient along the 5 cm cathode which is conducive to the flow of extracted current during the heating pulse duration. Note that, in FIGS. 5*b*, 5*c*, 5*d*, this current is seen to abruptly disappear upon the removal of the voltage heat pulse. This is because the voltage gradient across the cathode abruptly decreases to zero. It should be further noted that, in a preferred operation of a line cathode, the voltage polarity shown in FIG. 4 is reversed, thereby impeding current flow during the heating pulse duration.

Referring now to FIG. 5*a*, it can be seen that a heating voltage pulse of less than about 40 volts provides no extracted current. This is so whether the nickel tube 19 is biased at 0 volts or some positive voltage. Thus, the particular cathode described herein has a threshold voltage of about 40 volts.

In the absence of a positive dc extraction voltage to the nickel tube (anode) 19 (see FIGS. 5*b, c, d*), application to the cathode of 50 μsec duration, 40 volt to 70 volt amplitude heat pulses at 30 Hz produced extracted currents with amplitudes which varied from about 0 to 2 mA. Also, in the absence of the positive dc extraction voltage at the nickel tube 19, a small amount of current is seen in FIGS. 5*b, c, d*, to exist before the heating pulse is applied to the cathode. The presence of this small amount of current results from residual space charge in the porous emission oxide which, in the absence of a positive extract voltage on tube 19, accumulates during the time interval between heat pulses when the tube has no positive bias. This residual charge is extracted at the initial application of the voltage gradient along the cathode.

Figure 6:
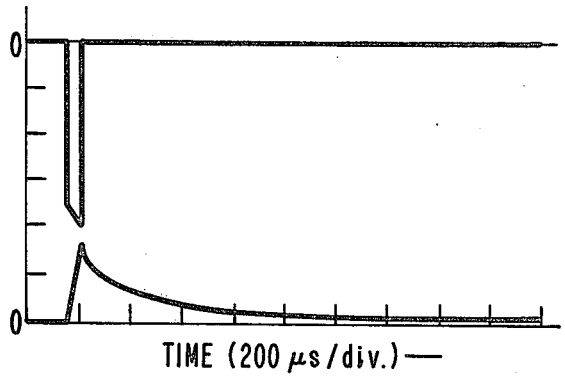
FIGS. 6*a*, *b* are a series of graphs similar to the ones shown in FIGS. 5*a* . . . *g* in which a reduced time scale is provided.
Figure 6:
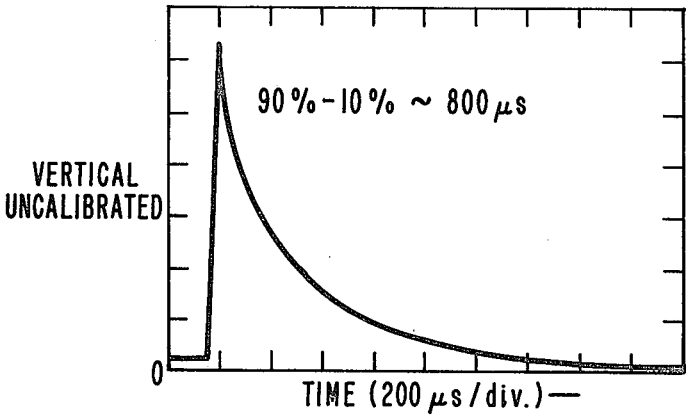

FIGS. 5*e, f, g*, show the extracted current in the presence of a positive 75 volts dc potential applied to the nickel tube (anode) 19. In this case, although the heating voltage pulse and corresponding gradient have disappeared after 50 μsec, the extracted current persists. This is because the cathode remains hot for a period of hundreds of microseconds after the heating voltage pulse has been removed. In this connection, note that FIGS. 6*a, b*, depict a reduced time scale of 200 μsec per division and show that the extracted current decreases from 90% to 10% over a period of about 800 μsec.

DISCUSSION OF EXAMPLE

The measured 2 mA anode current along the 5 cm cathode length is an adequate amount for longer line cathodes with intended use in display devices, i.e., a 90 cm length would ostensibly provide 36 mA. However, the heating voltage and current over the 50 μsec interval necessary to produce the 2 mA current is about 750 mA and 60 volts, corresponding to a power of 45 watts. This power is considerably higher than necessary for practical devices for several reasons: end losses in this example account for about 30% and could be reduced considerably. Also the cathode diameter can be reduced to reduce radiative losses. Finally there was strong evidence that cathode contamination was present.

GENERAL DISCUSSION

Figure 7:
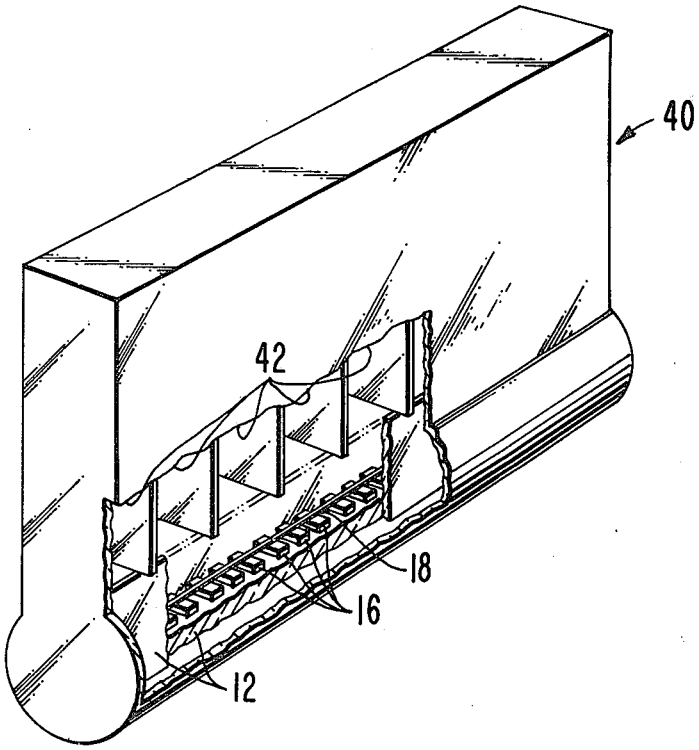
FIG. 7 is a partially cut away perspective view showing a display device including one form of the cathode structure of the present invention.

Referring now to FIG. 7, a display device which includes a cathode structure of the present invention is generally designated 40. The display device 40 includes a line cathode 18 and electron beam guide means 42. The line cathode 18 is made of oxide coated tungsten, as previously described, and has a length of about 1 meter and a diameter of about 250 microns. The line cathode in the display device 40 is operated as previously described. If the exemplary circuit, shown in FIG. 4 is utilized, several modifications are necessary. One modification is that the output of the power supply 34 of FIG. 4 should be directed through terminal 13 to the apertured grid 22 (see FIG. 1). Note that separate modulation potentials would have to be supplied to the electrode pads 16 through the terminals 15 with the electrode pads at cut off potential during the heating pulse. For additional information concerning modulation, see previously mentioned copending application of Ser. No. 784,365. Further information on the display device 40 of FIG. 7 can be found in copending applications of Ser. No. 607,492, entitled "Flat Electron Beam Addressed Device," filed Aug. 25, 1975, now U.S. Pat. No. 4,031,427, issued June 21, 1977 and Ser. No. 615,353 entitled "Guided Beam Flat Display Device," filed Sept. 22, 1975, now U.S. Pat. No. 4,028,582, issued June 7, 1977, which are hereby incorporated by reference.

In a preferred method of operating the line cathode 18 in the display device 40 in a line-at-a-time addressing scheme, the heating pulse duration is about 10 μsec followed by a cooling period of about 50 μsec. The temperature of the cathode at the termination of the heating pulse is about 1100° K. In such a scheme it may be desirable to limit the cathode temperature drop over the cooling period to e.g. less than about 25° K. More specifically, in this scheme, the operation of the cathode includes the following: Heating the cathode (which is at cut-off modulation potential) for a period of about 10 μsec to bring the cathode to its desired operating temperature. Then, during the following 50 μsec cooling period, the modulation potential is changed to "on" condition and the beam guide means 42 function to display a line in the display device. In a line-at-a-time addressing scheme, the heating period (10 μsec) corresponds to the retrace time between line times of 50 μsec. The material and dimensions of the cathode can be varied in accordance with the intended use thereof.

The methods and structures of the present invention are capable of many structural variations. For example, although the cathode structure has been shown as a line cathode in combination with a plurality of control pads and an apertured grid, other control elements are available. Also, the dimensions of the structure are not critical although the preferred embodiments are directed toward line cathodes having diameters less than about 1000 microns. Further, the methods and structures of the present invention are not limited to large flat image display devices but are generally useful in many types of display devices.

Although the cathode of the present invention has heretofore been described as being provided in a preferred embodiment with substantially constant heating voltage pulses, variations are possible. For example, if the heating pulses are substantially identical (but not individually constant), the cathode will still function as previously described with the cathode temperature being substantially uniform. Further, the voltage pulses may be both non constant and not identical. In this case, uniformity of cathode temperature will be provided as long as the root mean square of the voltage over the pulse duration is substantially the same among the pulses.

In other variations, the cathode may be pulsed with discrete constant electrical power or constant current pulses. Of these two variations, the constant power approach is more desirable as it will generally provide more uniform heating of the cathode as such an approach is substantially independent of resistance changes which may occur in the cathode. The constant current pulsing scheme is less desirable as resistance changes in the cathode cause a positive feedback situation where the cathode temperature can become unstable. This is to be contrasted with the preferred constant voltage pulsing scheme in which a negative feedback situation is present whereby an increase in cathode resistance is accompanied by a decrease in power, a subsequent cooling, and therefore a decrease in resistance. Thus, in the preferred constant voltage pulsing scheme, changes in cathode resistance tend to be self-compensating, thereby promoting stable cathode temperature.

It is to be noted that the heating-cooling cycle provided for the cathode of the present invention is itself subject to many variations. For example, the cycle need not be uniform in the sense that each of the heating and cooling periods are respectively of the same duration and/or magnitude. Indeed, the predetermined time period which separates consecutive ones of the heating pulses may continue for random intervals, or even unknown intervals, as long as the predetermined time period between heating pulses is such that current can be extracted from the cathode during a portion thereof.

Also, although the line cathode of the present invention has heretofore been described as one cathode supported at opposing ends, variations are possible in which a plurality of smaller length cathodes are placed end to end (not shown), each of the cathodes being operated in accordance with the present invention. Such a variation may be desirable where cathode support is available and/or cathode vibration is a concern.

Thus, there is provided by the present invention, methods and structures for utilizing a directly heated line cathode for use in a flat image display device.

I claim:

1. A method of operating a directly heated line cathode, comprising the steps of:

(a) providing said cathode with a plurality of discrete heating current pulses therethrough with a predetermined time period separating consecutive ones of said discrete heating pulses; and (b) extracting current from said cathode during at least a portion of said predetermined time period.

2. A method in accordance with claim 1 in which step (a) comprises providing said cathode with a plurality of substantially constant electrical power pulses.

3. A method in accordance with claim 1 in which step (a) comprises providing said cathode with a plurality of voltage pulses.

4. A method in accordance with claim 3 in which step (a) comprises providing said cathode with a plurality of substantially constant voltage pulses.

5. A method in accordance with claim 3 in which substantially no current is extracted from said cathode during step (a).

6. A method in accordance with claim 5 where said cathode is operated in a line-at-a-time addressing scheme and in which steps (a) and (b) extend over consecutive time periods such that step (a) is performed during the retrace time between line on times and step (b) is performed during the line on time.

7. A method in accordance with claim 6 in which step (a) is performed over a time period of about 10 μsec and step (b) is performed over a time period of about 50 μsec.

8. A cathode structure, which comprises:

(a) a directly heated line cathode which emits electrons upon the passage of heating current therethrough;

(b) means for providing said cathode with a plurality of discrete heating current pulses therethrough with a predetermined time period separating consecutive ones of said discrete current pulses; and (c) means for extracting current from said cathode wherein said current is extracted during at least a portion of said predetermined time period.

9. A cathode structure in accordance with claim 8 in which said means for providing said heating pulses include means for providing said cathode with a plurality of substantially constant electrical power pulses.

10. A cathode structure in accordance with claim 8 in which said means for providing said heating pulses includes means for providing said cathode with a plurality of voltage pulses.

11. A cathode structure in accordance with claim 10 in which said means for providing said heating pulses includes means for providing said cathode with a plurality of substantially constant voltage pulses.

12. An image display device of the type having an evacuated envelope with a cathodoluminescent screen therein, a line source of electrons, means for guiding electrons from the line source to the cathodoluminescent screen, wherein said line source of electrons comprises:

(a) a directly heated line cathode which emits electrons upon the passage of heating current therethrough;

(b) means for providing said cathode with a plurality of discrete heating current pulses therethrough with a predetermined time period separating consecutive ones of said pulses;

(c) means for providing that substantially no current is extracted from said cathode during said heating pulses; and (d) means for extracting current from said cathode with current being extracted during at least a portion of said predetermined time period.

13. An image display device in accordance with claim 12 in which said means of (b) includes means for providing said cathode with a plurality of voltage pulses.

14. An image display device in accordance with claim 13 in which said means of (b) includes means for providing said cathode with a plurality of substantially constant voltage pulses.

15. An image display device in accordance with claim 12 which includes means for providing line-at-a-time addressing in which said heating pulses extend over a time period which corresponds to the retrace time between line on times and in which said means of (c) includes means for extracting current during the line on time.

16. An image display device in accordance with claim 15 in which said means of (b) includes means for providing heating pulses of 10 μsec duration and said means of (c) includes means for extracting current during the following 50 μsec time period.

* * * * *